United States Patent [19]

Buku

[11] Patent Number: 4,537,376

[45] Date of Patent: Aug. 27, 1985

[54] FRAME FOR HOLDING PLASTIC BAG

[76] Inventor: Berniece Buku, 6846 Brandt Pike, Apt. A, Huber Heights, Ohio 45424

[21] Appl. No.: 539,321

[22] Filed: Oct. 5, 1983

[51] Int. Cl.[3] ..... A63B 55/04

[52] U.S. Cl. ..... 248/97; 248/101

[58] Field of Search ..... 248/95, 97, 99, 100, 248/101; 403/150; 46/45, 47

[56] References Cited

U.S. PATENT DOCUMENTS

| | | | |
|---|---|---|---|
| 1,680,286 | 8/1928 | Ettlinger | 248/100 X |
| 2,557,731 | 6/1951 | Felsing | 47/47 |
| 2,731,184 | 1/1956 | Thurber, Jr. | 248/99 X |
| 3,265,415 | 8/1966 | Wubbe | 403/150 |
| 3,559,339 | 2/1971 | Worley | 47/45 |
| 3,831,650 | 8/1974 | Consorti | 248/99 X |
| 3,916,962 | 11/1975 | Stolt | 248/101 X |
| 3,934,803 | 1/1976 | Paulus, Jr. | 248/99 |
| 3,997,072 | 12/1976 | Guth | 248/101 X |

*Primary Examiner*—J. Franklin Foss
*Assistant Examiner*—David L. Talbott
*Attorney, Agent, or Firm*—Becker & Becker, Inc.

[57] ABSTRACT

A structure including a collapsible and retractable frame to fit or go inside a plastic bag of a type used for gathering leaves, weeds and/or clippings of grass, bulky materials such as garbage or trash, paper towels or other disposable items to be packaged in the plastic bag. The frame has four upright corner or side rods pivotally interconnected by double hinges relative to four upper rod members and four intermediate rod members without any bottom interconnections. Rubber tips are fitted to lower free ends of each of the four upright corner or side rods. A semicircular handle has opposite ends thereof twisted pivotally to a pair of parallel upper rod members so that the frame can be fitted and unfolded in a plastic bag as well as removed therefrom and folded flat for storage purposes. Clips are used to hold the plastic bag to the four upper rod members. The rubber tips at the lower ends of the corner or side rods prevent tearing and/or possible puncturing of the plastic bag held open in a squared-rectangular configuration subject to closing of the open top of the bag by plastic-coated wire twist or string or rope to hold disposable materials in the plastic bag after unobstructed removal and retraction of the frame structure therefrom.

10 Claims, 5 Drawing Figures

FRAME FOR HOLDING PLASTIC BAG

The present invention relates to a collapsible and retractable frame to fit or go inside a plastic bag of a type used for gathering leaves, weeds and/or clippings of grass and the like. A need exists in gardens and households to facilitate filling of such plastic bags without loss of time and without difficulty in spreading open the plastic bag or without difficulty in bag removal after filling thereof.

BACKGROUND OF THE INVENTION

The field of the invention includes applicability in yard work and landscape gardening where leaves, weeds and/or clippings of grass or other bulky materials such as garbage or trash, for example, are disposed of by use of a large bag made of soft, pliable plastic material, including polyethylene and the like, that is not self supporting though initially open at one end closed off when filled by using a suitable plastic-coated wire twist or string or rope to tie up and close the top of the plastic bag.

DESCRIPTION OF THE PRIOR ART

As a matter of expediency, such plastic bags have been attempted to be inserted in a substantially cylindrical container such as a drum or garbage can of metal or molded plastic, but difficulty is encountered when trying to place the empty plastic bag therein to spread out adequately and uniformly and/or when trying to remove such plastic bag therefrom easily without binding or tearing due to bulky materials packed tightly therein. Also, a dual-wheel cart exists having a loop at the top of the plastic bag on the loop near the handle of the cart. However, no frame and/or any rod or hinge structure capable of being folded flat would be available with such a commercially available cart.

A bag holder of expired U.S. Pat. No. 1,403,751—Edstrom dated Jan. 17, 1922 is illustrative of early attempts to provide a specific form of bag engaging member at a time when flexible plastic bags were not yet known.

Expired U.S. Pat. No. 1,653,393—Cox dated Dec. 20, 1927 also discloses a holder for bags during filling operation whereby frame members are adapted for swinging to lie parallel with a hinge of a uniting frame when the frame is in folded position, or at right angles thereto when the frame is in extended position.

Most recent, though also expired, U.S. Pat. No. 2,731,184—Thurber dated Jan. 17, 1956 shows corner supports pivotally joined at only one end for disposable refuse containers and combinations thereof.

Another paper sack holder of expired U.S. Pat. No. 3,186,667—Meuer dated June 1, 1965 has U-shaped uprights secured by legs thereof to an outer base believed unsuitable for plastic bags to be held open successfully to be filled with leaves, weeds and/or grass clippings.

A bag support stand of U.S. Pat. No. 3,905,406—Cruse dated Sept. 16, 1975 includes an upper base hingedly connected at fore and aft longitudinal ends to first and second U-shaped leg assemblies foldable to accommodate various sizes of bags.

A bag holder and dispenser of U.S. Pat. No. 4,175,602—Cavalaris et al dated Nov. 27, 1979 has a pair of parallel Z-shaped members joined laterally at a lower end to permit bag suspension inboard thereof.

A further holder for a plastic trash bag is shown by U.S. Pat. No. 4,196,880—Hynes dated Apr. 8, 1980 using first and second generally U-shaped frame sections disposed horizontally to maintain the mouth of the bag in a fully open position.

Finally, a recent U.S. Pat. No. 4,332,361—McClellan dated June 1, 1982 shows a bag holder support system using a pair of wire brackets each having a generally U-shaped wire member pivotally mounted and movable within the bag after the bag is suspended on the brackets.

SUMMARY OF THE INVENTION

An object of the present invention is to provide a frame made of wood dowels, metal bars or rods, or molded plastic pieces assembled in such a manner that the frame is to go inside a plastic bag of the type used for gathering leaves, weeds, clippings of grass, trash, garbage and similar bulky materials for which the frame holds the plastic bag open while clips similar to metal clamps or spring-biased tweezers or even clothespins can be provided to hold or secure the plastic bag open at the top of the frame; when the plastic bag is about three-fourths full, then the subject frame is pulled out via a pivotally attached handle and the plastic bag, after being made free of the frame, is tied using a suitable plastic coated wire twist or string or rope to tie up and close the top of the plastic bag.

This object, and other objects and advantages of the present invention, will appear more clearly from the following specification, in connection with the accompanying drawings.

DESCRIPTION OF A PREFERRED EMBODIMENT

Figure 1:
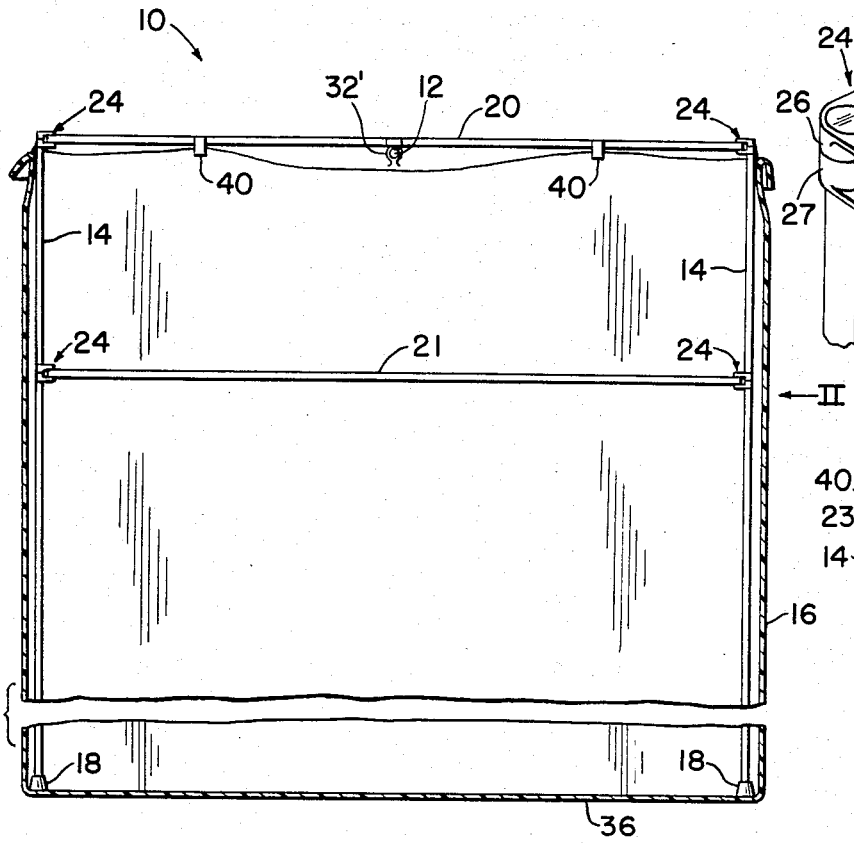
FIG. 1 is a side elevational view of a plastic-bag-holding frame having features in accordance with the present invention taken in the direction of Arrow I in FIG. 2.
Figure 2:
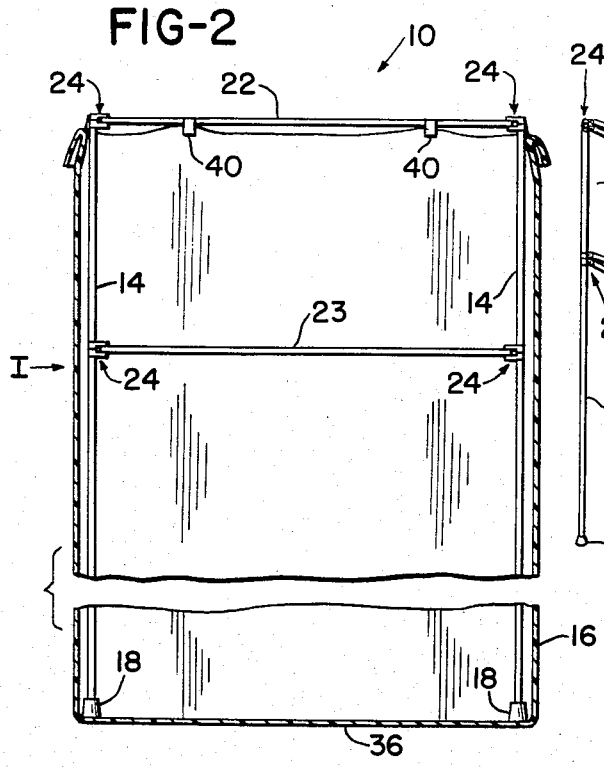
FIG. 2 is an end elevational view of the frame taken in the direction of Arrow II in FIG. 1.

Referring now to the drawings in detail, the bag-opener frame 10 of FIGS. 1 and 2 collectively includes a handle 12 as well as a pair of 56-inch rods for the sides 14 at four corner locations once the frame 10 is inserted inside a plastic bag 16 having a capacity or volume in a range of 58 to 60 gallons, such bag 16 of plastic, for example of polyethylene, being typically commercially available for garden use, hospital use, institutional use, etc. No rod or cross member at all is provided to interconnect between ends of the side rods 14 relative to each other, but rather four rubber or plastic tips 18 are fitted or telescoped to the free end of the side rods 14 are precluded or hindered from puncturing the plastic bag 16 during insertion and/or use or removal of the frame 10 relative to the plastic bag 16.

A pair of side rods 14 can be interconnected by trasnsverse width rods or beam members 20, 21 on each side of the frame 10 at front and back of the bag 16, each of the width members 20, 21 having a length of approximately 21-½ inches across the top and middle of the frame 10 according to FIG. 1. Similarly, transverse depth rods or spacer members 22, 23 on each end of the frame 10 are secured transversely between pairs of side rods 14 as illustrated in FIG. 2.

Figure 3:
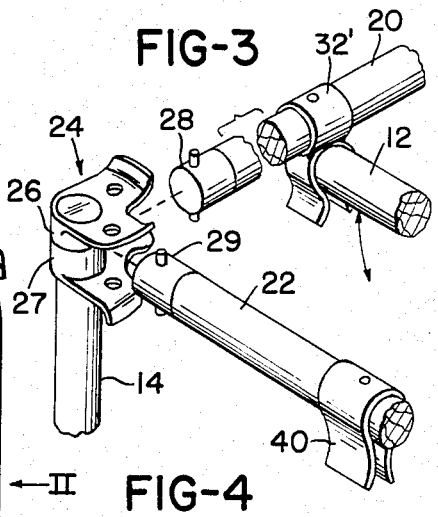
FIG. 3 is a fragmentary perspective view of a hinge junction used with the frame of FIGS. 1 and 2 in accordance with the present invention.

Provision is made to have eight double hinges or pivots 24 provided at the junctures between the rods 14, 20–21, and 22–23. An enlarged perspective view of such a double hinge or pivot 24 is shown in FIG. 3, each thereof including a pair of central loop portions 26, 27 fitted snugly around each corner or side rod 14 and fastener or crimp portions 28, 29 respectively secured to the beam and spacer members such as 20, 21 and 22, 23 respectively. The handle 12 is twisted at the opposite free ends 32 thereof around the middle of the upper depth rods or spacer members 22 used as a side opener for the plastic bag 16 when the frame 10 is inserted inside the plastic bag 16 to hold the plastic bag open for stuffing thereof with leaves, grass clippings, weeds, paper towels or other disposable materials to be packaged in the plastic bag 16.

The frame 10 including width rods or beam members 20, 21 and depth rods or spacer members 22, 23 as well as the handle 12 can be made of precut or formed wood dowels, metal bars or rods or molded plastic pieces. The pieces are assembled as illustrated such that the frame 10 is hinged or pivotally joined to permit flattening or folding thereof into a substantially pancake-like configuration; also, unfolding thereof is made possible into a box-like shape of FIG. 4 in a perspective view showing an outline thereof with respect to a bag 16 having a bottom 36 against which the rubber tips 18 abut without tearing or puncturing the plastic bag 16 or bottom 36 thereof. A plastic-coated wire twist or string or rope 38 is used to tie up and close the top 39 of the plastic bag 16.

Figure 4:
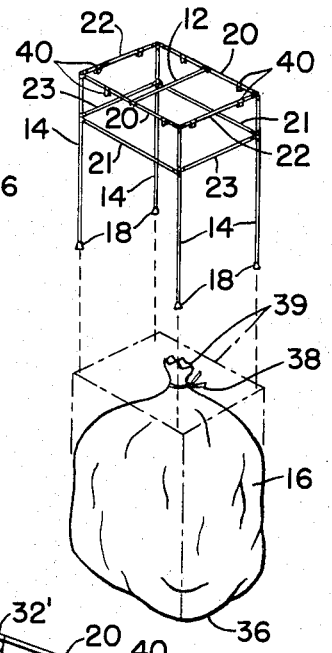
FIG. 4 is a perspective view of a plastic bag outlined as held in combination with the frame of the present invention.
Figure 5:
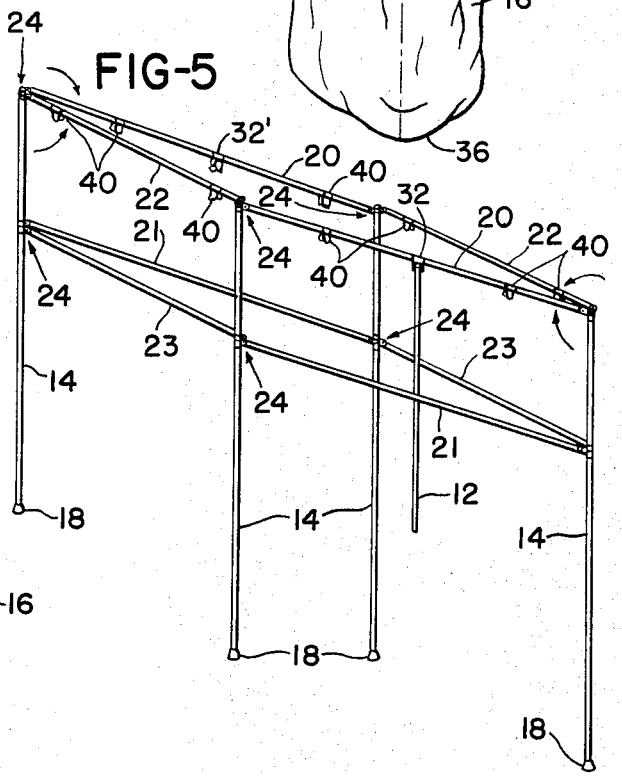
FIG. 5 shows the plastic-bag-holding frame folded flat for storage.

The subject frame 10 can be folded flat for storage as outlined in FIG. 5 and the bailing-wire-like handle 12 can lie down flat relative to the upper width rods or beam members 20 and upper depth rods or spacer members 22 as outlined in FIG. 2, while using the opener frame 10 in the plastic bag 16 itself held in position by clips 40 as indicated in FIG. 4.

The parts needed preferably include only the following:

(1) eight (8) double hinges 24 for folding when the frame is not in use;

(2) four 56-inch rods 14;

(3) four 21-½ inch rods 20,21;

(4) four 14-inch rods 22,23;

(5) one 24-inch wire handle 12;

(6) four rubber tips 18; and (7) clips 40 to hold the bag 16 to the upper rods 20,22 of the frame 16.

In FIG. 3, one side of the handle or bale has been left off and there is to be understood that one end of the handle or bale can be hooked off to facilitate filling of the open top of the plastic bag 16; and also, the handle or bale 12 of FIG. 4, capable of being unhooked on at least one end according to FIGS. 1, 3 and 5, can be used to facilitate folding down thereof subject to being snapped on again as to the top frame rim for transporting purposes. The handle or bale can be fitted relative to longer or shorter pairs of rectangular top frame beams or rails, or if a square top beam or rail configuration is provided, then either pair of top rail bars or rods can be the connection for the handle to catch thereon for the purpose of pulling the frame out of the plastic bag 16. With at least one end of the handle so removable from the top frame members, then the remaining end of the handle is still secured to the top rail, rod, beam or member and can be left loose to hang down for storage purposes subject to clamping or fastening via a clamp to snap on the other side or end of the handle. Also, such arrangement would help to make sure the frame will not collapse. A spring clip 32' is attached to an inner side of the top beam member 20 as represented in FIG. 3 and this clip 32' holds an end of the handle securely between opposite resilient arms of the clip 32'. Also, the bar or beam members 20,22 can have opposite axial projections 28,29 respectively, at ends thereof to fit into complementary opposite hinge holes provided by hinges 24 as shown in the fragmentary enlarged view of FIG. 3. Even if the top bars or beams 20,22 are made of flat bars to be a little stronger, rather than being round or cylindrical bars or beams, there is to be understood that the legs or side rods 14, 24 can be left round in cross section. Clothespin-like members or spring clips can be removably fitted to the top beams or top frame rim to hold the plastic bag 16 relative thereto during filling of the plastic bag 16 with leaves, grass clippings, trash, and the like.

The present invention is, of course, in no way restricted to the specific disclosure of the specification and drawings, but also encompasses any modifications within the scope of the appended claims.

What is claimed:

1. A structure including a collapsible and rectractable frame to fit inside a plastic bag of a soft, pliable plastic material including polyethylene and the like that is non-self-supporting though initially open at one end closed off when filled as used for gathering leaves, weeds, clippings of grass, bulky materials such as garbage, trash, paper towels and other disposible items, comprising:

four upright corner-side rods spaced from each other in parallel locations and having upper ends as well as lower ends;

four upper rod members interconnecting only upper ends of said upright rods;

four intermediate rod members interconnecting said upright rods only in locations approximately intermediate upper and lower ends of said upright rods; and double hinge means at eight juncture locations of said four upper rod members and said four intermediate rod members whereby said frame is unfoldable to fit into the plastic bag and foldable into a substantially flat storage configuration, each double hinge means including a pair of central loop portions fitted snugly around said four upright corner-side rods and including therewith projections laterally thereof connected to hold said upper and intermediate rod members therebetween.

2. A structure according to claim 1, wherein a wire handle has opposite ends thereof pivotally connected with a pair of parallel upper rod members.

3. A structure according to claim 2, wherein rubber tips are fitted snugly in engagement relative to lower free ends of each of said four upright corner-side rods to avoid any tear, rupture and puncturing of the plastic bag.

4. A structure according to claim 2, wherein said double hinge means have said loop portions articulated pivotally about said four upright corner-side rods and said projections extending angularly thereof.

5. A structure according to claim 4, wherein said double hinge means have crimp portions connected to respective upper and intermediate rod members extending horizontally substantially radially of said four upright corner-side rods.

6. A structure according to claim 5, wherein said wire handle folds down to a location adjoining upper rod members during opening of the plastic bag to place materials therein.

7. A structure according to claim 6, wherein a plastic coated wire is twisted to close the otherwise open top of the plastic bag when approximately three-fourths filled with materials.

8. A structure according to claim 6, wherein spring clips hold the bag open and fit each of said four upper rod members to which the plastic bag is temporarily secured.

9. A structure according to claim 8, wherein all said upright rods and rod members are made entirely of dowels.

10. A structure according to claim 9, wherein all of said dowels are made of rigid polypropylene plastic.

* * * * *